US006962553B2

(12) United States Patent
Stout et al.

(10) Patent No.: US 6,962,553 B2
(45) **Date of Patent: *Nov. 8, 2005**

(54) AQUATIC EXERCISE DEVICE

(75) Inventors: Tadlington A. Stout, La Jolla, CA (US); James P. Cleary, San Diego, CA (US)

(73) Assignee: Aqualogix, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/872,214

(22) Filed: Jun. 18, 2004

(65) Prior Publication Data

US 2004/0259691 A1 Dec. 23, 2004

Related U.S. Application Data

(60) Provisional application No. 60/479,714, filed on Jun. 19, 2003.

(51) Int. Cl.[7] ..... A63B 21/008; A63B 31/10

(52) U.S. Cl. ..... 482/111; 482/44; 482/51; 482/55; 482/92

(58) Field of Search ..... 482/44, 51, 55, 482/56, 92, 108, 111, 139; 441/56; 472/128; D21/678, 807; 473/612–615

(56) References Cited

U.S. PATENT DOCUMENTS

| | | | | | |
|---|---|---|---|---|---|
| 4,468,023 | A | * | 8/1984 | Solloway | 482/10 |
| 4,623,142 | A | * | 11/1986 | MacKechnie | 482/111 |
| 4,632,387 | A | * | 12/1986 | Guzman | 482/111 |
| D299,365 | S | * | 1/1989 | Greeley | D21/678 |
| 4,819,951 | A | * | 4/1989 | Solloway | 482/111 |
| 5,031,904 | A | | 7/1991 | Solloway | |
| 5,033,739 | A | * | 7/1991 | MacKechnie | 482/111 |
| D344,113 | S | * | 2/1994 | Shelton et al. | D21/678 |
| 5,531,657 | A | * | 7/1996 | Macedo | 482/111 |
| 6,109,990 | A | * | 8/2000 | Lundberg | 441/64 |
| 6,671,993 | B1 | * | 1/2004 | Routt | 43/4.5 |
| 6,672,993 | B2 | | 1/2004 | Stout | |
| 2004/0053749 | A1 | | 3/2004 | Stout | |
| 2004/0116256 | A1 | * | 6/2004 | Stout et al. | 482/55 |

FOREIGN PATENT DOCUMENTS

| | | | | |
|---|---|---|---|---|
| FR | 2707510 | A1 * | 1/1995 | A63B 69/00 |

* cited by examiner

*Primary Examiner*—Jerome W. Donnelly
*Assistant Examiner*—Victor K. Hwang
(74) *Attorney, Agent, or Firm*—Gavrilovich, Dodd & Lindsey, LLP

(57) ABSTRACT

An aquatic exercise device provides uniform omni-directional and uniform omni-rotational resistance to movement in water. The device includes a plurality of fins arranged on an outer surface of a dome-shaped or semi-spherical bell. The fins include lateral resistance members such as flanges for additional rotational resistance or a resistance plate that creates a resistance during a punching motion. The bell includes an opening and a handle coupled to an interior of the opening.

20 Claims, 9 Drawing Sheets

AQUATIC EXERCISE DEVICE

CROSS REFERENCE TO RELATED APPLICATIONS

This application claims the benefit of priority of U.S. Provisional application Ser. No. 60/479,714 filed on Jun. 19, 2003, entitled "Aquatic Exercise Device" and which is incorporated by reference in its entirety herein.

BACKGROUND

The following description relates in general to physical exercise and physical therapy, and more specifically to an apparatus and method for exercise and physical therapy in water.

Aquatic physical exercise has been found to be one of the best forms of exercise. Water supports an individual's body and alleviates most of the effects of gravity allowing the individual to exercise prescribed specific muscle groups without stressing other areas of the body. The reduced physical strain on these other area allows the individual to exercise for longer periods of time. The individual is also able to exercise longer due to a lower and more stabilized body temperature resulting from contact with the water. Strain on the heart, muscles and ligaments is minimized while the benefits of physical activity are maximized.

Accordingly, aquatics-based physical therapy is most noticeably gaining popularity with the elderly, the obese, and the infirm. There is a huge demand for an exercise modality which provides long-term health benefits and which can exist in the favorable environment of lower stress and freer movement. Conventional aquatic exercise devices and methods, however, are limited in several ways. For example, conventional devices do not offer uniform resistance when moved through the water. As a result, the devices feel awkward and unstable to the user. Further, conventional devices do not provide the appropriate resistance for exercises designed to develop muscles used in a punching motion. A preferred punching motion often includes rotating the fist while the arm is extended. Most conventional devices are not easily rotated.

Therefore, there exists a need for an aquatic exercise device and method that provide uniform resistance to the user independent of device orientation.

DETAILED DESCRIPTION

In the exemplary embodiment of the invention, an aquatic exercise device provides the user with a uniform resistance during a punching motion independent of device orientation, while allowing the device to be rotated as the user's arm is extended. The exemplary aquatic exercise device includes a dome-shaped bell having an opening and a plurality of apertures adapted to allow water flow when the device is moved through water. A handle connected within an interior of the dome-shaped bell is accessible by a human hand through the opening.

The dome-shaped bell has a plurality of fins symmetrically arranged along an outer surface of the dome-shaped bell. The fins are arranged symmetrically along at least one axis that extends from the user's arm out through a top of the bell. A resistance plate connected to the dome-shaped bell tangentially to the apex of the dome-shaped bell provides additional resistance during a punching motion in the exemplary embodiment. Depending on the desired resistance mode, additional resistance plates can be connected in any of several positions on the dome-shaped bell in some circumstances. In the exemplary embodiment, a series of tapered flanges are attached to the fins providing additional rotational resistance perpendicular to the user's arm.

Figure 1:
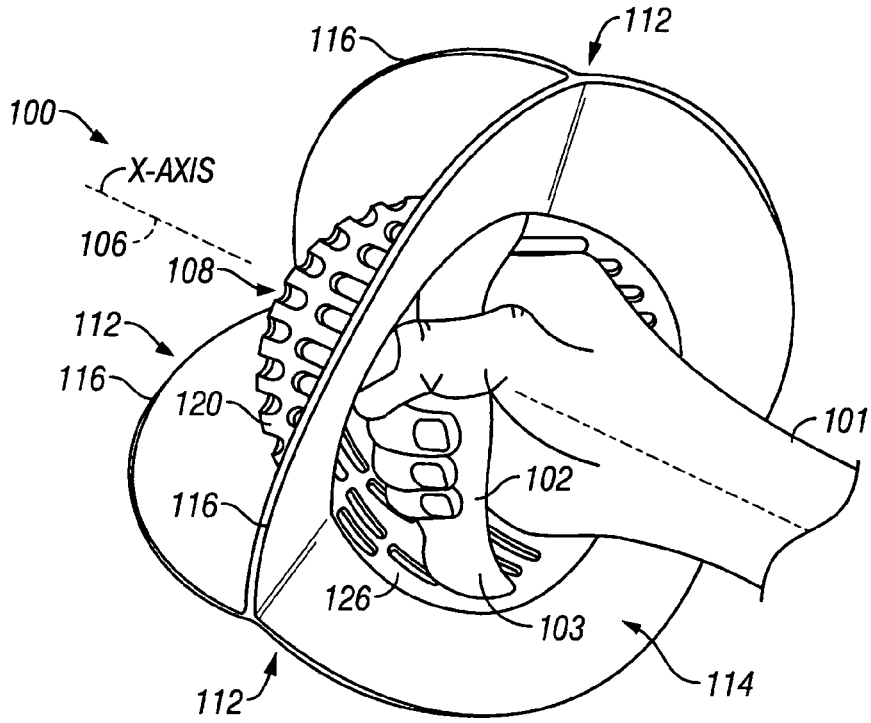
FIG. 1 is an illustration of a perspective view of the aquatic exerciser device from the rear with an individual user's hand holding the handle attached to the interior surface of the bell in accordance with exemplary embodiments of the invention.
Figure 2:
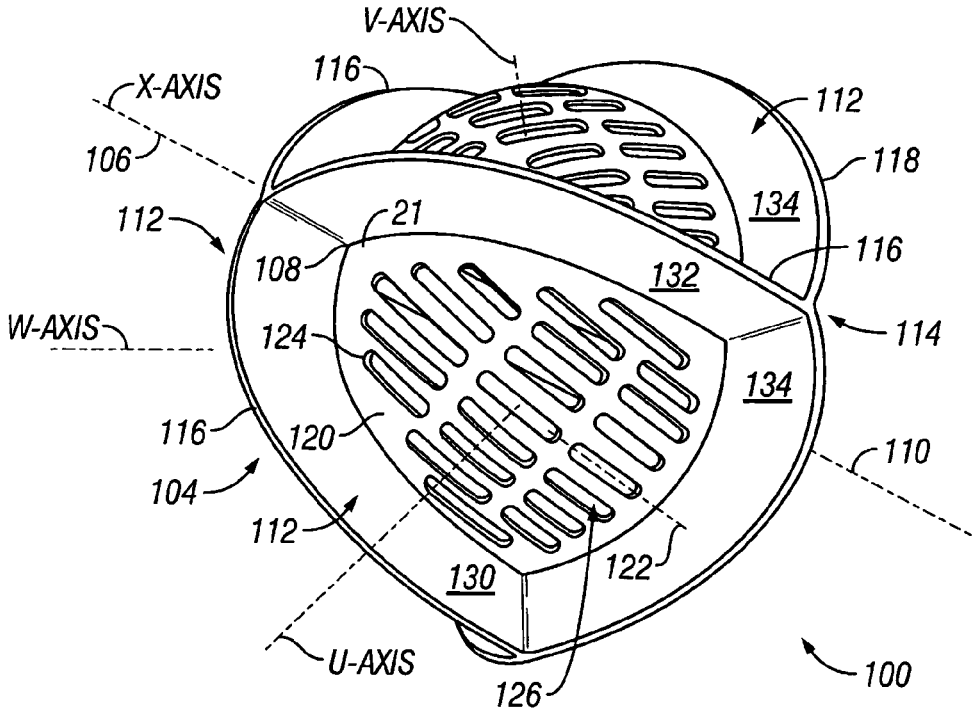
FIG. 2 is an illustration of a perspective view of the aquatic exercise device in accordance with the exemplary embodiments of the invention.

FIG. 1 and FIG. 2 are illustrations of perspective views of a bell assembly 100 of an aquatic exercise device in accordance with the exemplary embodiments of the invention. FIG. 1 shows a human hand 101 gripping a handle 102 within the bell assembly 100. The bell assembly 100 includes a dome-shaped bell 104 having an opening 114 opposite an apex 108, a handle 102, and a plurality of fins 116. As discussed below, the exemplary embodiments of the invention include one of more lateral resistance members that are part of, or connected to, one or more of the plurality of fins 116. The lateral resistance members may include a resistance plate or a flange that is positioned laterally (perpendicular or nearly perpendicular) to a fin. For clarity, the lateral resistance members are not shown in FIG. 1–FIG. 3. The dome-shaped bell 104 has a bell axis 106 extending from an apex 108 of the dome-shaped bell 104 to the center of the bell opening 114. The handle 102 is connected to the dome-shaped bell 104 such that a handle axis 110 is perpendicular to the bell axis 106 in the exemplary embodiments. In some circumstances, however, the handle 102 may be positioned at an angle other than 90 degrees to the bell axis 106.

The dome-shaped bell 104 may be formed using a variety of techniques and materials. An example of a suitable construction is discussed in U.S. Pat. No. 6,672,993, Ser. No. 10/044,552, entitled "Aquatic Exercise Device" issued Jan. 6, 2004 and which is incorporated by reference herein. Generally, in the exemplary embodiments, the dome-shaped bell 104 has a symmetrical polyhedron shape similar to a bell and is configured to minimize differences in resistance due to changes in the direction of motion through water. Two or more curved sections 112 are secured to each other to form an at least partial ovoid that gradually expands from the apex 108 to its widest point at the bell opening 114. The dome-shaped bell 104, therefore, formed from the plurality of sections 112 is an ovoid where the base of the ovoid coincides with the bell opening 114. In the exemplary embodiment, the dome-shaped bell 104 is formed from three identical curved sections 112 that are secured to each other using an adhesive or bonding agent. The dimensions and shape of the sections 112 depend on the number of sections 112 used to form the dome-shaped bell 104. As the number of sections 112 increases, the width of each section 112 decreases. Alternatively, the dome-shaped bell 104 is formed from a single ovoid piece that provides any number of sections 112.

A three dimensional coordinate system having an X-axis perpendicular to a U-axis, a V-axis, and a W-axis is shown in FIG. 1. The X-axis extends from the apex 108 and along the center of the dome-shaped bell 104 and, therefore, coincides with the bell axis 106. The U-axis, V-axis, and W-axis each extend from the X-axis through a midpoint between the axial fins of each section 112. The angles between the U-axis, V-axis, and W-axis, therefore, depend on the number of sections 112 used to form the particular dome-shaped bell 104. The dome-shaped bell 104, therefore, is a semi-spherical bell in the exemplary embodiments where the shape partially conforms to a spherical contour or nearly spherical contour.

In the exemplary embodiments, each section 112 includes an outer surface 120 outlined by two axial fins 116 and a transverse fin 118 where each axial fin 116 of each section 112 is secured to an axial fin 116 of another section to form a single axial fin 116. In some circumstances, the fins 116, 118 may be omitted and the sections 112 are secured to each other at the axial edges of the sections 112. In the exemplary embodiments, the axial fins 116 and the transverse fins 118 extend perpendicular to a tangent line on the spherical surface 120 and the transverse fins 118 extend at an angle greater than ninety degrees from the X-axis. The transverse fins 118, therefore, extend slightly away from the apex 108 in the exemplary embodiments. The fins 116, 118, however, may be of any size and shape and may extend at any angle from the tangent line on the spherical surface 120. The axial fins are parallel to the bell axis 106 (and X-axis) and the transverse fin 118 is transverse to the X-axis 106.

The spherical surface 120 of each section includes a plurality of apertures 124 configured to allow water flow and stabilize movement of the aquatic exercise device 100 as it is moved through the water. The apertures 124 may have any of several shapes, sizes and arrangements. In one suitable arrangement, the apertures 124 are elongated along a central axis 122 through each of the apertures 124. The central axis 122 of each aperture 124 points toward the bell apex 108. The apertures 124 provide additional stability to the aquatic exercise device 100 during use by venting water through the apertures 124 in a direction that minimizes twisting when the device 100 is moved by the user in a back and forth motion through the water along the X-axis. In some situations, the fins 116, 118 may also be formed with apertures to provide a calculated flow and to maximize stability. When the aquatic exercise device is moved backwards through the water (in a direction from the apex 108 toward the bell opening 114), the angled transverse fins 118 form a funnel that channels water into the inner chamber 126. The resistance created when the aquatic exercise device 100 is pushed and pulled along the X-axis through the water can be adjusted by changing the size of the apertures 124. Accordingly, the aquatic exercise device 100 may include different-sized or adjustable-sized apertures 124 that allow a user to adjust the resistance to a desired leveling in some circumstances.

During use, the user grasps the handle 102 at a handgrip 103. The handgrip 128 may be in the shape of a pistol grip or a straight rod that is located inside or outside of the inner chamber 126. In the exemplary embodiments, the handgrip is inside the inner chamber 126 of the dome-shaped bell 104. The handgrip 103 is constructed of any material that provides additional friction between the user's hand and the handle 102 allowing the user to grip the handle 102. The handgrip 103 may be a softened or pliable layer attached to the handle 102, for example, such as rubber or neoprene. In some circumstances the handgrip 103 or handle 102 may include an attachment mechanism such as, for example, a glove or hook-and-loop attachment often referred to as "Velcro" for allowing a user with a weak or non-existent grip to utilize the aquatic exercise device. In some circumstances, the attachment mechanism includes a glove sized for a user for gripping a particular-sized handgrip 103, in which the glove may include one or more abutment elements for attaching to the handgrip 103.

When the bell assembly 100 is laterally moved through the water, the angle of the fins 116, 118, and the pressure on the three fin surfaces 130, 132, 134 direct the force along the U-axis, V-axis, and W-axis axis. When the bell assembly 100 is thrust forward, parallel to the bell axis 106 or X-axis, the sections 112 work in combination to produce a balanced force of resistance along the X-axis with minimal twisting force. In the exemplary embodiment, the changes in force magnitude due to changes in the direction of motion are minimized since the dome-shaped bell 104 is symmetrical around the X-axis (bell axis) 106. The resistive force on the dome-shaped bell 104 is translated to the user through the handle 102.

Figure 3:
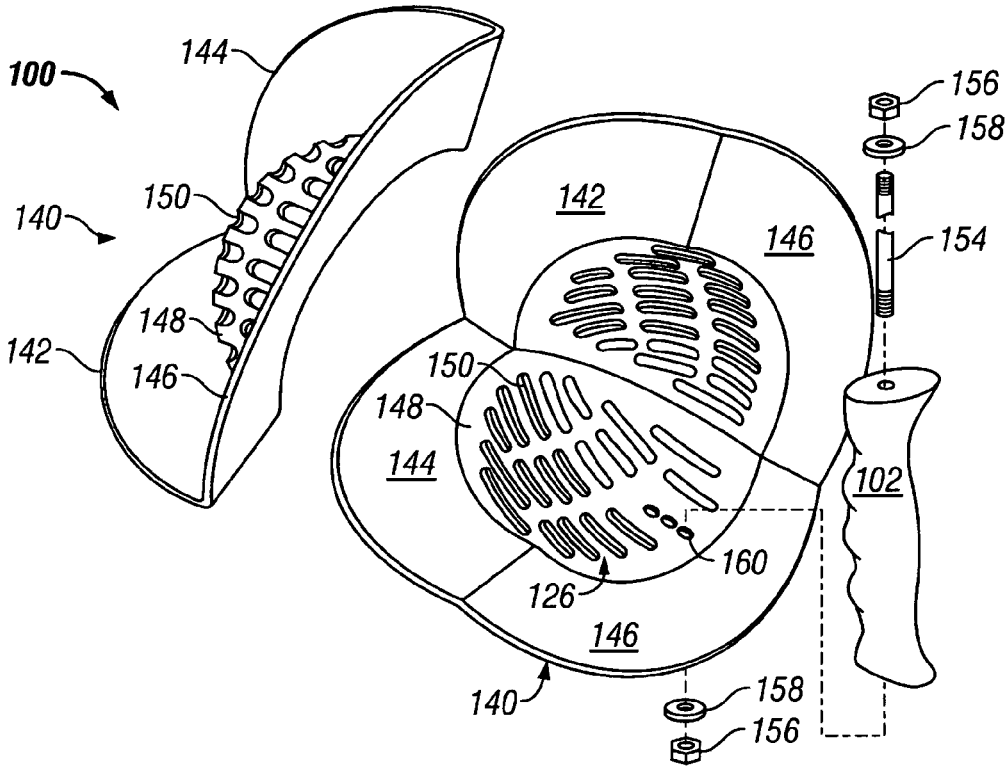
FIG. 3 is an illustration of a perspective exploded view of the device with the bell formed with each quadrant being a separate piece, showing one quadrant removed with the handle and mounting hardware in accordance with the exemplary embodiments.

FIG. 3 is an illustration of an exploded perspective view of the bell assembly in accordance with the exemplary embodiments. The bell assembly 100 includes quadrants 140 that are separate identical pieces that can be attached together by any one of a number of conventional methods, as in snapping together, glue or fasteners. Each quadrant 140 may include three separate fins 142, 144 and 146 with a spherical surface 148 having a plurality of apertures 150. The handle 102 can be removably attached, by attaching to the handle 102 to one of a plurality of attachment points with a threaded rod 154, nut 156 and washer 158, at each end of the rod 154. Through the use of a number of mounting holes 160, the angle of the handle 102 within the inner chamber 126 can be adjusted for the comfort of the individual using the device, or optimized for a particular movement or user skill.

Figure 4:
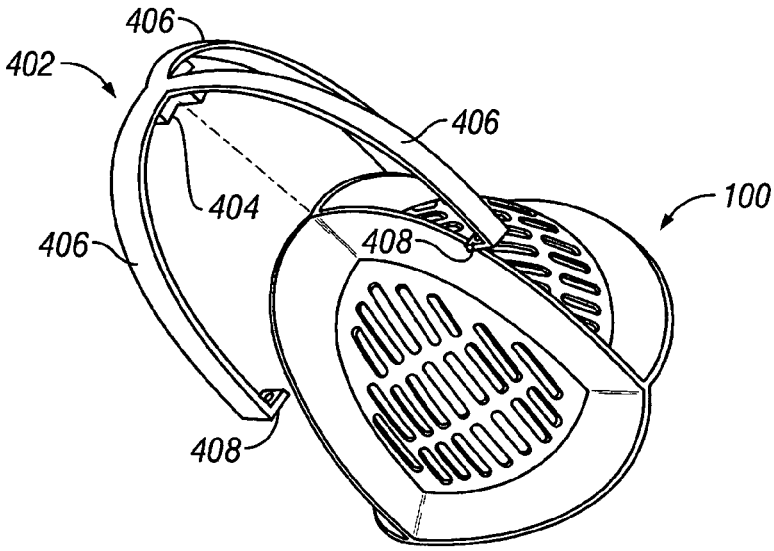
FIG. 4 is an illustration of a perspective exploded view of a flange member adapted for connecting to a bell assembly to form an aquatic exercise device in accordance with a first exemplary embodiment.

FIG. 4 is an illustration of a perspective view of a resistance member 402 attachable to the bell assembly 100 where the lateral resistance member includes a flange member 402 in accordance with a first exemplary embodiment. In one arrangement, the flange member 402 includes a number of flanges 406 (or arms) that matches the number of fins 116 on the bell assembly 100, and which can be mounted to the bell assembly 100 with a central alignment member 404 and an attachment mechanism such as a number of conventional fasteners on the ends 408 of each flange 406. The flange member 402, when attached to the bell assembly 100, provides additional forward, rearward and rotational resistance of the bell assembly 100 when the bell assembly is moved through water. The flange member 402 shown in FIG. 4 includes flanges 406 having a uniform width along the length of each flange 406.

Figure 5A:
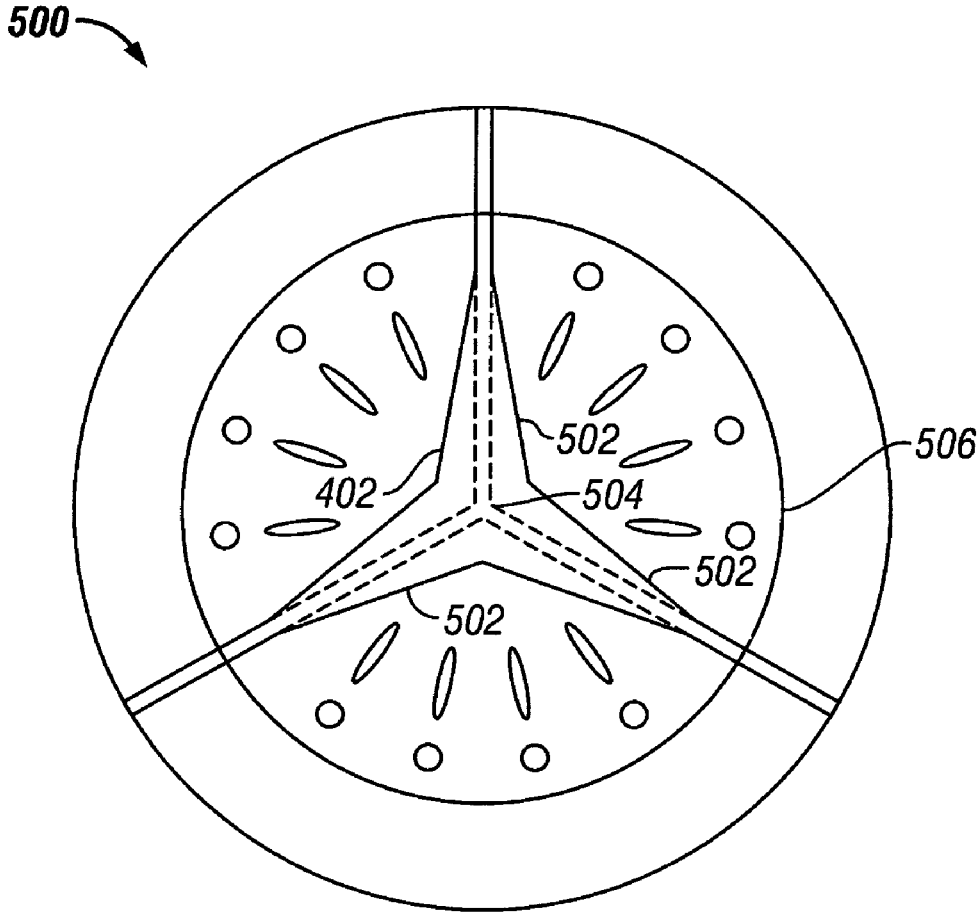
FIG. 5A is an illustration of a top view of an aquatic exercise device having a flange member with variable-width flanges in accordance with a second exemplary embodiment of the invention.
Figure 5B:
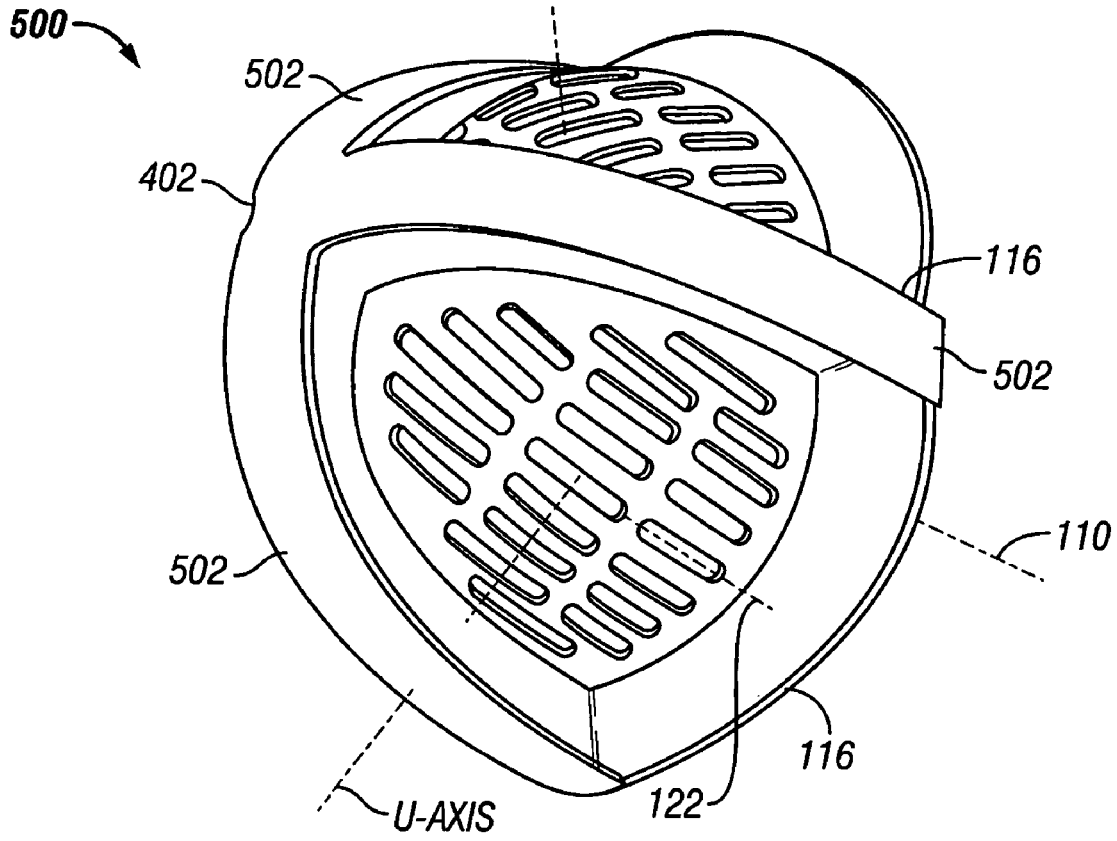
FIG. 5B is an illustration of a perspective view of an aquatic exercise device having a flange member with variable-width flanges in accordance with the second exemplary embodiment of the invention.
Figure 5C:
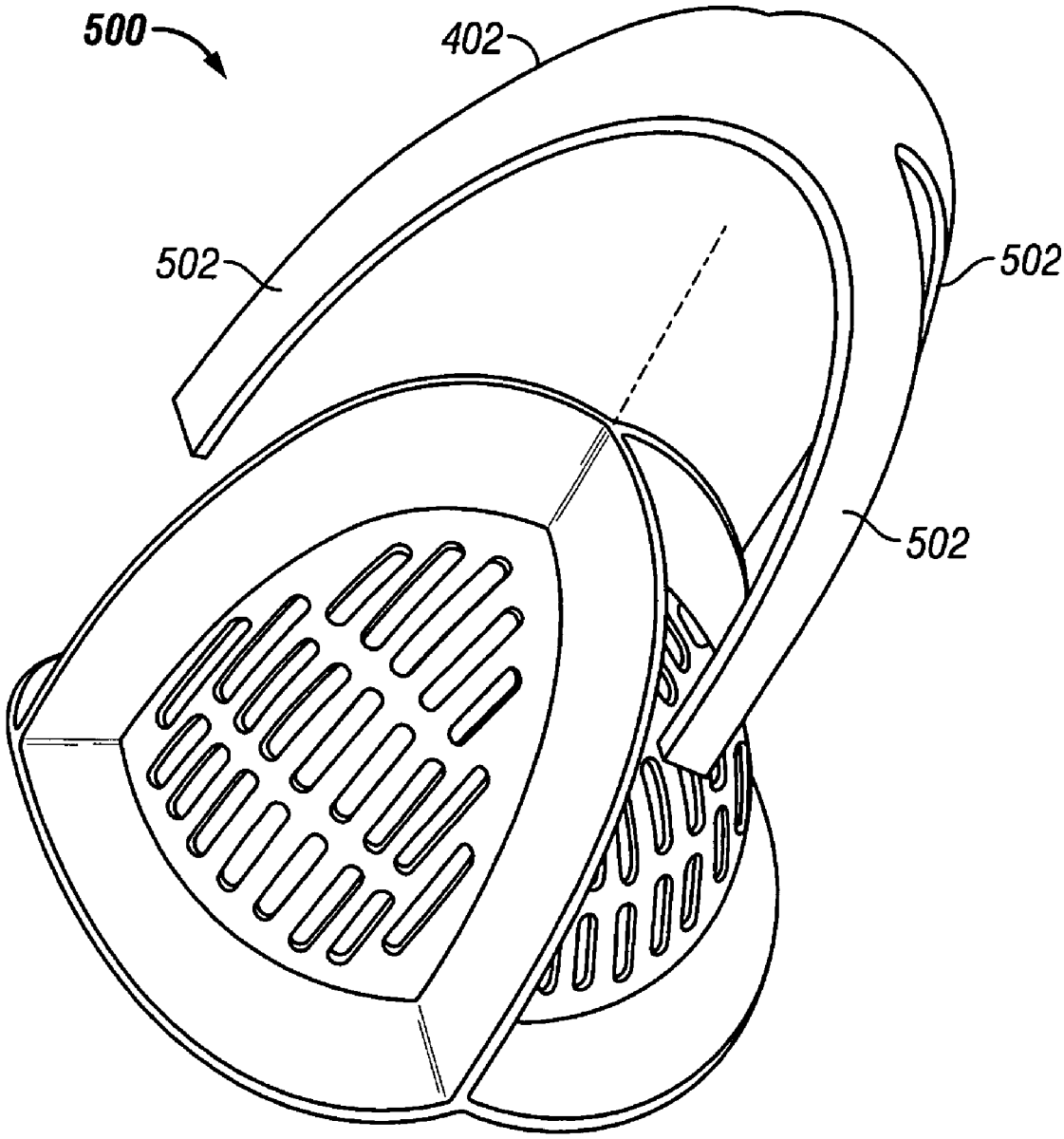
FIG. 5C is an illustration of an exploded perspective view of an aquatic exercise device having a flange member with variable-width flanges in accordance with the second exemplary embodiment of the invention.

FIG. 5A, FIG. 5B and FIG. 5C are illustrations of different views of an aquatic exercise device 500 having a flange member 402 with variable-width flanges 502 in accordance with a second exemplary embodiment where FIG. 5A is an illustration of a top view, FIG. 5B is an illustration of a perspective view and FIG. 5C is an illustration of an exploded view. In the exemplary embodiment, the flanges 502 are part of a flange member 402 that is permanently attached to the fins 112, 116 using an adhesive. The flanges 502, however, may be formed as part of each of the fins 112, 116 in some circumstances or may be connected using other techniques. Further, the flanges 502 may be individual separate pieces that are not interconnected as part of a flange member 402.

The flanges 502 may have any of several shapes and widths. In the second exemplary embodiment, the flanges have a variable width and have a greater width at the apex 504 of the dome-shaped bell and taper to a lesser width at the base 506 of the dome-shaped bell. In some circumstances, the flanges 502 may have a tapered-width portion and a uniform-width portion. For example, the flanges 502 may taper to a width along a top portion of the flange 502 and have a uniform width along the bottom portion of the flange 502. In some circumstances the flanges 502 may include apertures( not shown) to allow water flow-through during use. Also, the flanges may be positioned anywhere along the fins. For example, a flange 502 having a length less than the length of the fin may be positioned anywhere between the apex 504 and the base. Further, the flanges may be formed as part of the fin 112, 116 such that the flange is located between the dome-shaped bell and the outer perimeter of the fin rather than positioned at the outer perimeter as shown in FIGS. 5A–C.

Figure 6A:
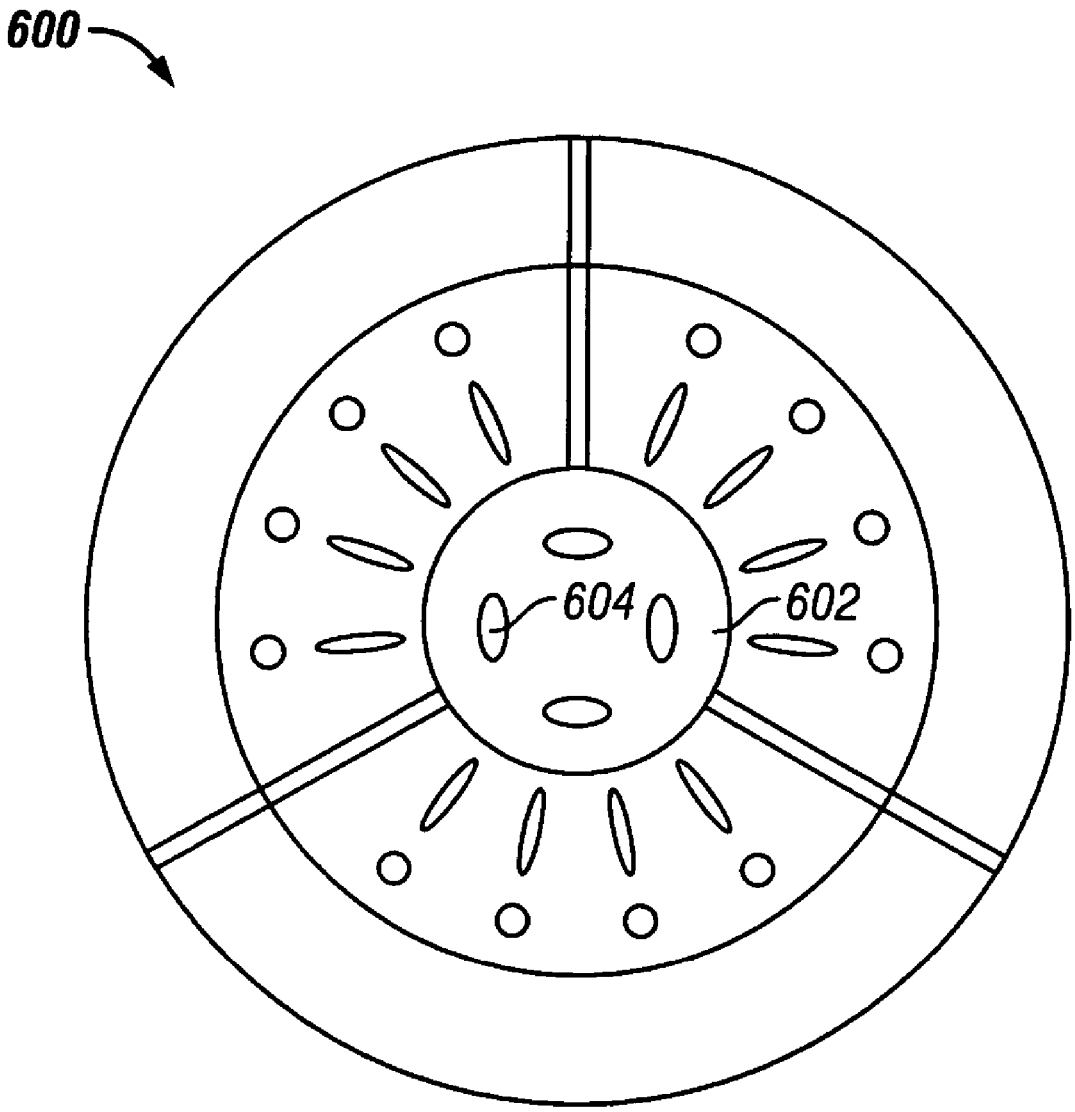
FIG. 6A is an illustration of top view of an aquatic exercise device including a resistance plate in accordance with a third exemplary embodiment of the invention.
Figure 6B:
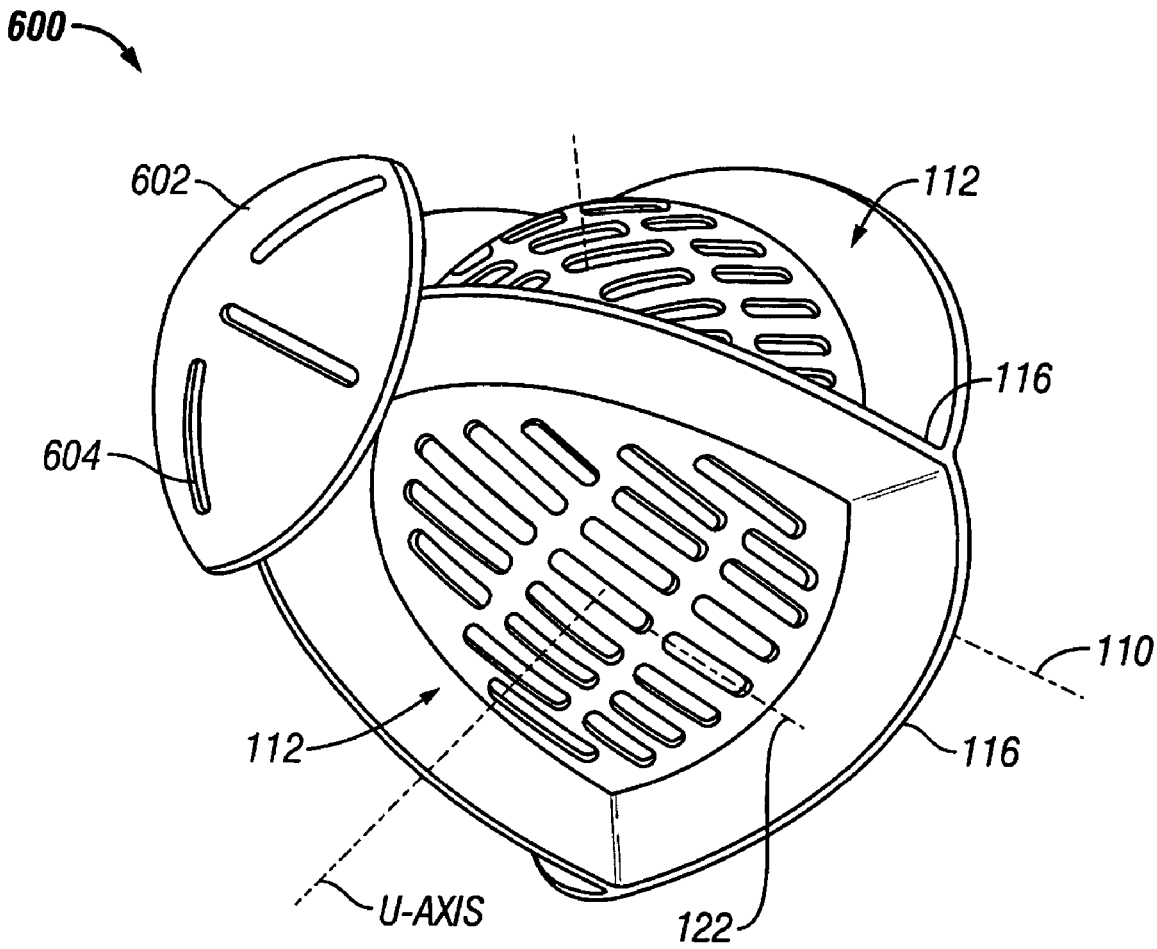
FIG. 6B is an illustration of a perspective view of an aquatic exercise device including a resistance plate in accordance with the third exemplary embodiment of the invention

FIG. 6A is an illustration of a top view and FIG. 6B is an illustration of a perspective view of an aquatic exercise device 600 including a resistance plate 602 as the lateral resistance member in accordance with a third exemplary embodiment of the invention. The exemplary aquatic exercise device 600 shown in FIG. 6A and FIG. 6B does not include flanges 502 as shown in FIG. 5A–FIG. 5C. In some circumstances, however, the exercise device may include flanges. The resistance plate 602 can be mounted on at least one fin anywhere in relation to the outer surface of the device. In the third exemplary embodiment, the resistance plate 602 is attached to all fins near the apex 504 of the device 600, and provides additional resistance, particularly in the forward and backward "punching and withdrawing" type movement in the water. The resistance plate 602 can be mounted at other various positions on the aquatic exercise device 600 to provide added resistance for, as example, lateral and/or rotational movement. In one example, the resistance plate 602 is symmetrically coordinated with the number of fins and/or quadrants of the device. The resistance plate 602 can have any shape. For example the resistance plate 602 can be circular, squared, or triangular, and may be concave, convex or flat. Further, the resistance plate 602 may have any number of plate apertures 604. In the third exemplary embodiment, the plate apertures 604 are symmetrically spaced.

Figure 7A:
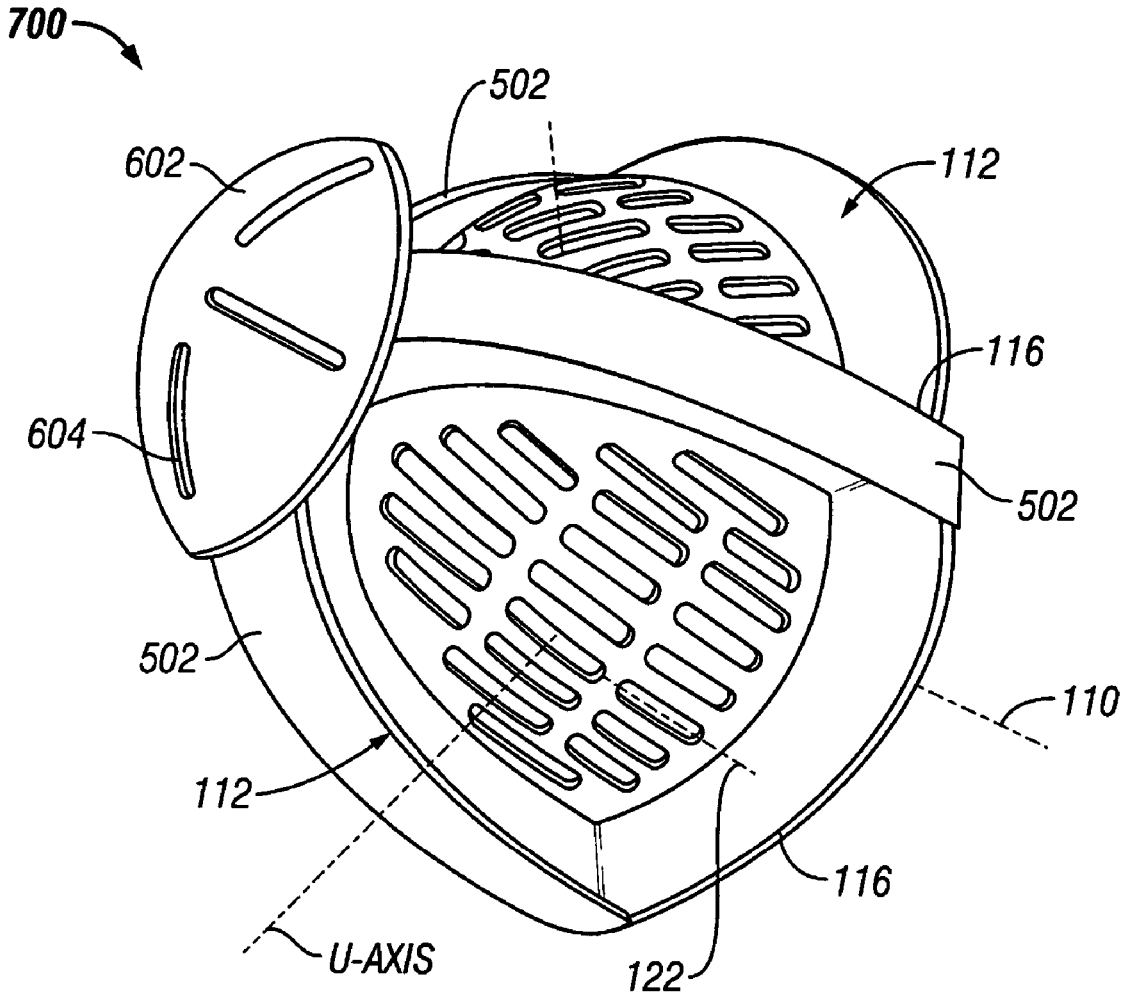
FIG. 7A is an illustration of a perspective view of an aquatic exercise device having flanges and a resistance plate in accordance with a fourth exemplary embodiment.
Figure 7B:
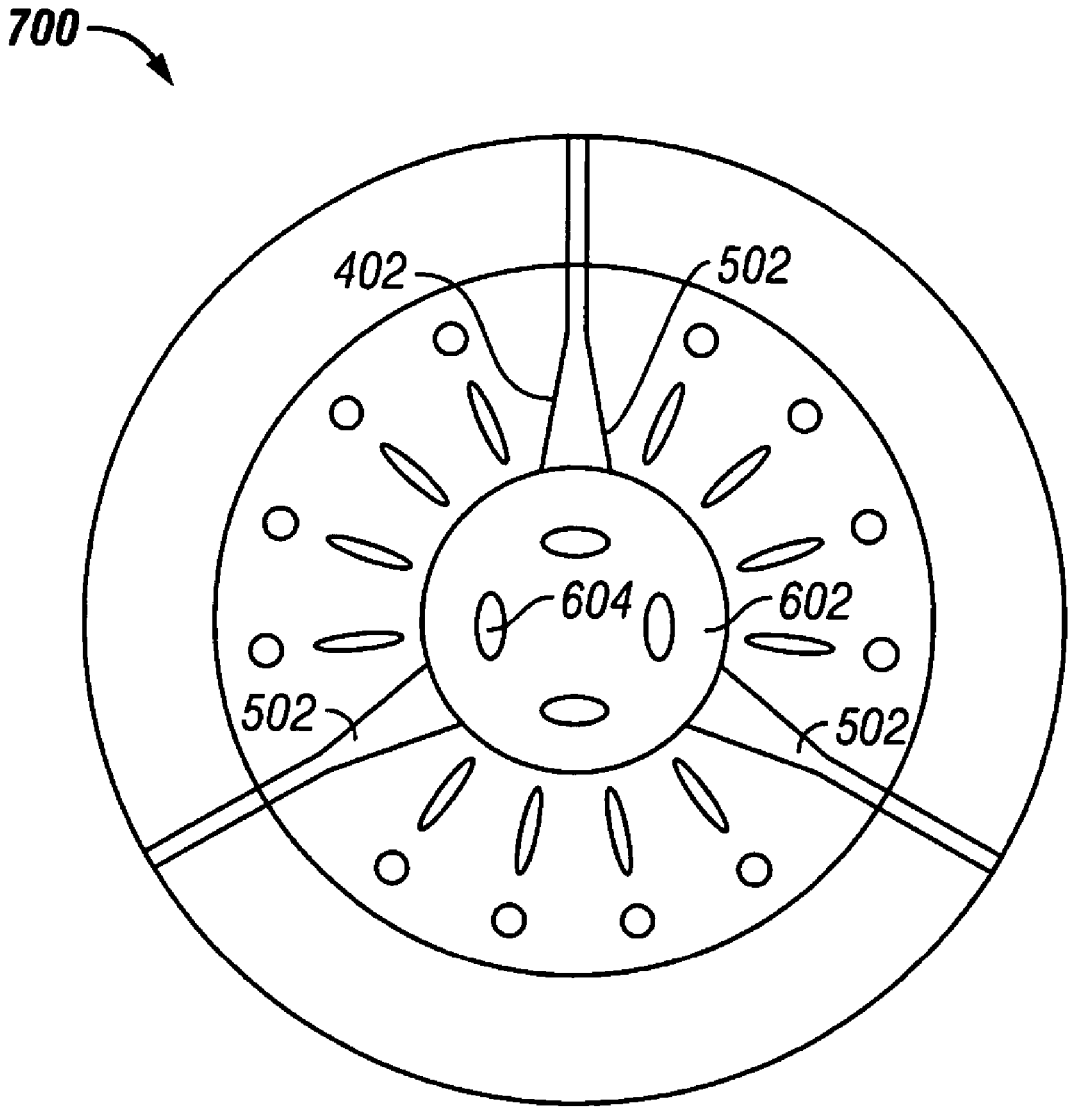
FIG. 7B is an illustration of a top view of an aquatic exercise device having flanges and a resistance plate in accordance with the fourth exemplary embodiment.

FIG. 7A is an illustration of a perspective view and FIG. 7B is an illustration of a top view of an aquatic exercise device 700 having flanges 502 and a resistance plate 602 as lateral resistance members in accordance with a fourth exemplary embodiment. The aquatic exercise device 700 may have any combination of tapered or uniform width flanges 502 and resistance plates 602. In the fourth exemplary embodiment, the flanges 502 are tapered and the resistance plate 602 is circular and slightly concave with plate apertures 604. The resistance plate may be solid, or have any number of plate apertures 604, however.

Therefore, lateral resistance members connected to the fins 116 of a bell assembly 100 provide additional resistance to the resistance provided by the plurality of fins 116. In the exemplary embodiments, the bell assembly 100 includes handle 102 connected to the dome-shaped bell 104 where the plurality of fins 116 extend from the spherical surface 120 of the dome-shaped bell 100. The lateral resistance members may include any combination of flanges 406 and resistance plates 602.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

We claim:

1. An aquatic exercise device comprising:

a dome-shaped bell comprising:

an opening;

a handle connected within an interior of the dome-shaped bell and accessible by a human hand through the opening;

a plurality of fins symmetrically arranged along an outer surface of the dome-shaped bell; and a resistance plate coupled to at least one of the plurality of fins.

2. A device in accordance with claim 1, further comprising a plurality of apertures, between the interior and the outer surface of the dome-shaped bell, adapted to allow water flow when the device is moved through water.

3. A device in accordance with claim 1, wherein the resistance plate is coupled to each of the plurality of fins.

4. A device in accordance with claim 3, wherein the resistance plate is coupled at a top of the dome-shaped bell.

5. A device in accordance with claim 4, wherein the resistance plate includes a plurality of apertures adapted to allow water flow when the device is moved through the water.

6. The device in accordance with claim 1, further comprising a flange extending perpendicular from at least a portion of at least one of the plurality of fins.

7. A device in accordance with claim 1, further comprising:

a plurality of flanges, each flange of the plurality of flanges laterally connected to a fin of the plurality of fins.

8. A device in accordance with claim 7, wherein the resistance plate is coupled to at least one of the fins and extending in a plane of the flange.

9. A device in accordance with claim 8, wherein the plane is a portion of a sphere.

10. A device in accordance with claim 8, wherein the resistance plate includes a plurality of apertures adapted to allow water flow when the device is moved through water.

11. An aquatic exercise device comprising:

a semi-spherical bell substantially symmetrical about an axis extending through a top of the bell;

a handle connected to an interior surface of the bell;

a plurality of fins arranged symmetrically along an outer surface of the bell and about the axis; and a resistance plate connected to at least one of the plurality of fins.

12. A device in accordance with claim 11, further comprising a plurality of flanges, each flange laterally connected to a fin of the plurality of fins.

13. A device in accordance with claim 11, further comprising a plurality of apertures through the bell and adapted to allow water flow when the bell is moved through water.

14. A device in accordance with claim 12, further comprising a plurality of apertures through the resistance plate and adapted to allow water flow when the bell is moved through water.

15. A device in accordance with claim 11, wherein the plurality of fins include a first set of fins originating at the top of the bell and extending to a periphery of an opening to the bell.

16. A device in accordance with claim 15, wherein the plurality of fins include a second set of fins extending from the periphery of the opening.

17. A device in accordance with claim 15, the resistance plate coupled to each of the first set of fins.

18. An aquatic exercise device, comprising:

a semi-spherical bell having an opening;

a handle coupled to an inside surface of the bell and accessible via the opening;

a plurality of longitudinal fins uniformly spaced apart on an outside surface of the bell; and a resistance plate coupled to the plurality of fins.

19. The device in accordance with claim 18, further comprising a plurality of apertures between the inside surface and the outside surface of the bell.

20. The device in accordance with claim 18, wherein each of the fins comprises a tangential flange.

* * * * *